US006478552B1

(12) United States Patent
Batten et al.

(10) Patent No.: US 6,478,552 B1
(45) Date of Patent: Nov. 12, 2002

(54) FLUID MOTIVATED PUMP

(75) Inventors: William C. Batten; Bruce W. Kyles, both of Asheboro, NC (US)

(73) Assignee: Thermaco, Inc., Asheboro, NC (US)

( * ) Notice: Subject to any disclaimer, the term of this patent is extended or adjusted under 35 U.S.C. 154(b) by 0 days.

(21) Appl. No.: 09/567,778

(22) Filed: May 9, 2000

(51) Int. Cl.[7] ..... F04B 17/00
(52) U.S. Cl. ..... 417/393; 417/401; 417/403
(58) Field of Search ..... 417/393, 399, 417/400, 401, 403, 404

(56) References Cited

U.S. PATENT DOCUMENTS

| | | | | | |
|---|---|---|---|---|---|
| 49,063 | A | | 8/1865 | Atwater | |
| 1,044,511 | A | | 11/1912 | Fountain | |
| 2,764,104 | A | | 9/1956 | Yeomans | |
| 3,253,547 | A | | 5/1966 | Weis | |
| 3,299,832 | A | | 1/1967 | Milne | |
| 3,369,703 | A | | 2/1968 | Reese | |
| 3,915,593 | A | | 10/1975 | Chamberlain | |
| 4,042,152 | A | * | 8/1977 | Drbal | 417/518 |
| 4,145,287 | A | | 3/1979 | Walker et al. | 210/104 |
| 4,184,506 | A | | 1/1980 | Varis et al. | |
| 4,235,726 | A | | 11/1980 | Shimko | |
| 4,268,396 | A | | 5/1981 | Lowe | |
| 4,385,869 | A | * | 5/1983 | Omata | 417/393 |
| 4,527,633 | A | | 7/1985 | McLaughlin et al. | |
| 4,625,801 | A | | 12/1986 | McLaughlin et al. | |
| 5,004,405 | A | | 4/1991 | Breslin | |
| 5,011,376 | A | | 4/1991 | Henriksson et al. | |
| 5,616,005 | A | * | 4/1997 | Whitehead | 417/393 |
| 5,637,233 | A | * | 6/1997 | Earrusso | 210/767 |
| 5,669,764 | A | * | 9/1997 | Behringer et al. | 417/395 |
| 5,893,707 | A | * | 4/1999 | Simmons et al. | 417/393 |
| 5,944,045 | A | * | 8/1999 | Allen et al. | 417/393 |

FOREIGN PATENT DOCUMENTS

| | | |
|---|---|---|
| GB | 1598068 | 9/1981 |
| GB | 2070694 | 9/1981 |
| SU | 853192 | 8/1981 |

OTHER PUBLICATIONS

"CETOP—3 Size Solenoid Operated Directional Valve," Pages from Grainger catalog obtained from the Internet; undated, possible prior art.

(List continued on next page.)

*Primary Examiner*—Cheryl J. Tyler
*Assistant Examiner*—Michael K. Gray
(74) *Attorney, Agent, or Firm*—MacCord Mason PLLC

(57) ABSTRACT

A device for pumping a stock fluid by supplying and discharging a motivating fluid to a unit is described. The device develops the suction and discharge of the stock fluid through the motion of a movable biasing boundary within a cavity. The movable biasing boundary divides the cavity into a stock fluid cell and a motivating-fluid cell. In the case that the movable biasing boundary comprises a piston, a link joined to the piston may extend outside of the unit as a means for driving the piston toward the motivating fluid cell. Each cell communicates with a fluid circuit that includes a source line, a valve or valves and a discharge line. The controlled supply and discharge of the motivating fluid to move the movable biasing boundary creates the discharge and suction of the stock fluid respectively. A valve directs the supply and discharge of the motivating fluid. Valves in the stock fluid circuit assist with the discharge and suction of the stock fluid from and into the stock-fluid cell to create the pumping action. The use of the devise in commercial food preparation and waste-water management applications to pump grease/water mixtures, grease and gray water is presented.

6 Claims, 10 Drawing Sheets

OTHER PUBLICATIONS

"Compact Air Cylinders," Pages from Grainger catalog obtained from the Internet; undated, possible prior art.

"Stainless Steel Body Air Cylinder and Accessories," Pages from Grainger catalog obtained from the Internet; undated, possible prior art.

"Nibco Commercial Bronze Valve," Pages from Grainger catalog obtained from the Internet; undated, possible prior art.

"Programmable Logic Controllers," Pages from Grainger catalog obtained from the Internet; undated, possible prior art.

"Sensors Controllers," Pages from Grainger catalog obtained from the Internet; undated, possible prior art.

"All About Pumps," from the Internet Glossary of Pumps, Oct. 19, 1998.

Linatex information from Valve Services Limited, copyright 1998.

* cited by examiner

FLUID MOTIVATED PUMP

BACKGROUND OF THE INVENTION

This invention pertains to a fluid motivated pump that may be used in locations where either it would be preferable not to use a pump having an electric motor or electricity is unavailable. A fluid motivated pump of the present invention may be used with food preparation equipment, wastewater equipment and a unit that separates a mixture of insoluble or immiscible fluids into its parts. For example, when used with food preparation equipment, a pump may deliver a grease/water mixture to a separator unit, a gray water part from the separator to a sewer line, and a grease part from the separator to a storage vessel.

Certain locations are hazardous because the atmosphere does or may contain gas, vapor or dust in explosive quantities. The National Electrical Code (NEC) divides these locations into Classes and Groups according to the type of explosive agent that may be present. Methane produced during sewage digestion in a wastewater treatment operation is a Class I, Group D atmosphere. Sparks or flames from a non-hazardous location electrical motor may ignite the methane and cause an explosion. A hazardous location electrical motor designed to withstand an internal explosion of methane, and not allow the internal flame or explosion to escape should be used. Two types of hazardous location electrical motors include a totally enclosed, fan-cooled electrical motor that has an external cooling fan and a totally enclosed, nonventilated, electrical motor that depends on convection for air cooling. A non-electrical alternative would be desirable.

Also, electrical current. leaking into water presents a hazard. For example, a unit used to separate a grease/water mixture into a gray water part and a grease part may include one or more pumps. A first pump may be used to transmit the grease part to a storage vessel. A second pump may be used to deliver the gray water part to a sewer line. To satisfy electrical codes, a ground-fault interrupter must protect the electrical lines to the motor of each pump. Watertight electrical boxes may also be required. The electrical lines should be either Type TW wires encased in metal or plastic conduit or Type UF (underground feeder) cable. These precautions are required to prevent electrical shock. Again, a non-electrical alternative would be desirable.

Submerged pumps can be even more challenging. For certain equipment, it is desirable to include a pump within the equipment. A reason may be esthetics. Another reason may be function. No matter the reason, a pump may be submerged in a reservoir of a water-based fluid. To prevent electrical current leakage, the pump, the electrical motor and wiring must be watertight. In a new pump installation, new and clean parts help water tightness; however, the upkeep of the electrical motor and wiring becomes a challenge over time because of the nature of the water-based fluid. If a grease/water mixture is involved, the grease bonds to the electrical motor casing and wire insulation over time. Also, the grease can hold bits of food and other debris and bond these to the motor and wiring insulation. The constant contact of grease and debris with wire insulation, wire conduit and materials for making watertight seals can rot them, leading to electrical current leakage. Also, replacing rotted parts is nasty. The built-up grease must be removed to create clean surfaces. During cleaning, the built-up grease clings to tools and clothing. A large amount of clothing and cleaning rags is thrown out after becoming fouled with grease. Again, a non-electrical alternative would be desirable.

It is apparent that there is a need for a pump that uses a motive method other than an electrical motor. It is also apparent that there is a need for a pump that reduces or eliminates explosion hazards and electrical current leakage hazards.

SUMMARY OF THE INVENTION

A pump according to the present invention conveys or pumps a fluid (later called a stock fluid) through a motivating fluid provided at a preselected pressure acting against a movable biasing boundary. A pump according to the present invention includes at least one unit having a cavity in fluid communication with at least one valve and at least one additional valve. The at least one valve regulates the providing and discharging of the motivating fluid while the at least one additional valve regulates the drawing or suctioning and discharging of a stock fluid. The movably biasing boundary splits the cavity into a stock-fluid cell and a motivating-fluid cell. Walls of the cavity and at least a portion of the movable biasing boundary define each cell. A motivating-fluid port is in fluid communication with the at least one valve and the motivating-fluid cell. A stock-fluid port is in fluid communication with the at one additional valve and the stock-fluid cell.

In a first embodiment, the movable biasing boundary comprises a piston movably disposed within the cavity and a biasing element, such as, a spring, acting on the piston and against the pressure of the motivating fluid. The biasing element may be internal to and/or external to the unit. When external to the unit, the biasing unit may act on the piston through a link. A piston may include a seal at its perimeter contacting the cavity walls to prevent the contamination of the motivating fluid by the stock fluid and vice versa.

A pump according to the present invention conveys or pumps at least one stock fluid by directing a motivating fluid through the at least one valve, into the motivating-fluid cell to act on the movably biasing boundary. This action expands the motivating-fluid cell, contracts the stock fluid cell and balances the preselected pressure of the motivating fluid. The at least one valve is then actuated so that the motivating fluid is discharged from the motivating-fluid cell as it contracts through the relaxation of the movably biasing boundary. Concurrently, the stock-fluid cell expands to draw the stock fluid through the at least one additional valve and into the stock fluid cell. The at least one valve and at least one additional valve are actuated to again direct motivating-fluid into the motivating-fluid cell, contract the stock-fluid cell and convey or pump the stock fluid through the at least one additional valve. The repeated alternating between expanding and contracting of the stock-fluid cell conveys the stock fluid. The repeated alternating to convey the stock fluid occurs by the coordinated actuation of the at least one valve and the at least one additional valve. A controller may be used to coordinate the actuation.

In another embodiment, the at least one valve comprises a solenoid actuated valve having two alternative paths. The at least one additional valve comprises two check valves, more preferably, duckbill check valves. One check valve is directed to permit stock fluid to be drawn into the stock-fluid cell during its expansion; the other check valve is directed to permit stock fluid to be conveyed or pumped from the stock-fluid cell during its contraction.

A pump according to the present invention may include a plurality of units or convey a plurality of stock fluids or both. When at least two units are paired, their movable biasing boundaries may be coupled so that they act in opposition, eliminating the need for other biasing components like springs. This provides additional operating and space saving advantages.

A pump according to the present invention uses a fluid as the motive force, eliminating the need for an electrical motor. In this manner, a pump according to the present invention reduces or eliminates explosion hazards and electrical current leakage hazards. In this vein, a pump according to the present invention may be used, for example, in commercial food preparation operations, in wastewater operations, and any other suitable operation that would be apparent to one skilled in the art.

Most preferably the motive fluid is a municipal or other convenient water supply, delivered at its conventional pressure.

BRIEF DESCRIPTION OF THE DRAWINGS

These and other features, aspects and advantages of the present invention will be better understood by those skilled in the art after a review of the following description, appended claims, and accompanying drawings where:

DETAILED DESCRIPTION OF PREFERRED EMBODIMENTS

Applicants discuss below several embodiments of a fluid motivated pump and an embodiment including fluid motivated pump. After reading this detailed description of the preferred embodiment, those skilled in the art will appreciate that other embodiments for the present invention exist and may be contemplated.

Figure 1A:
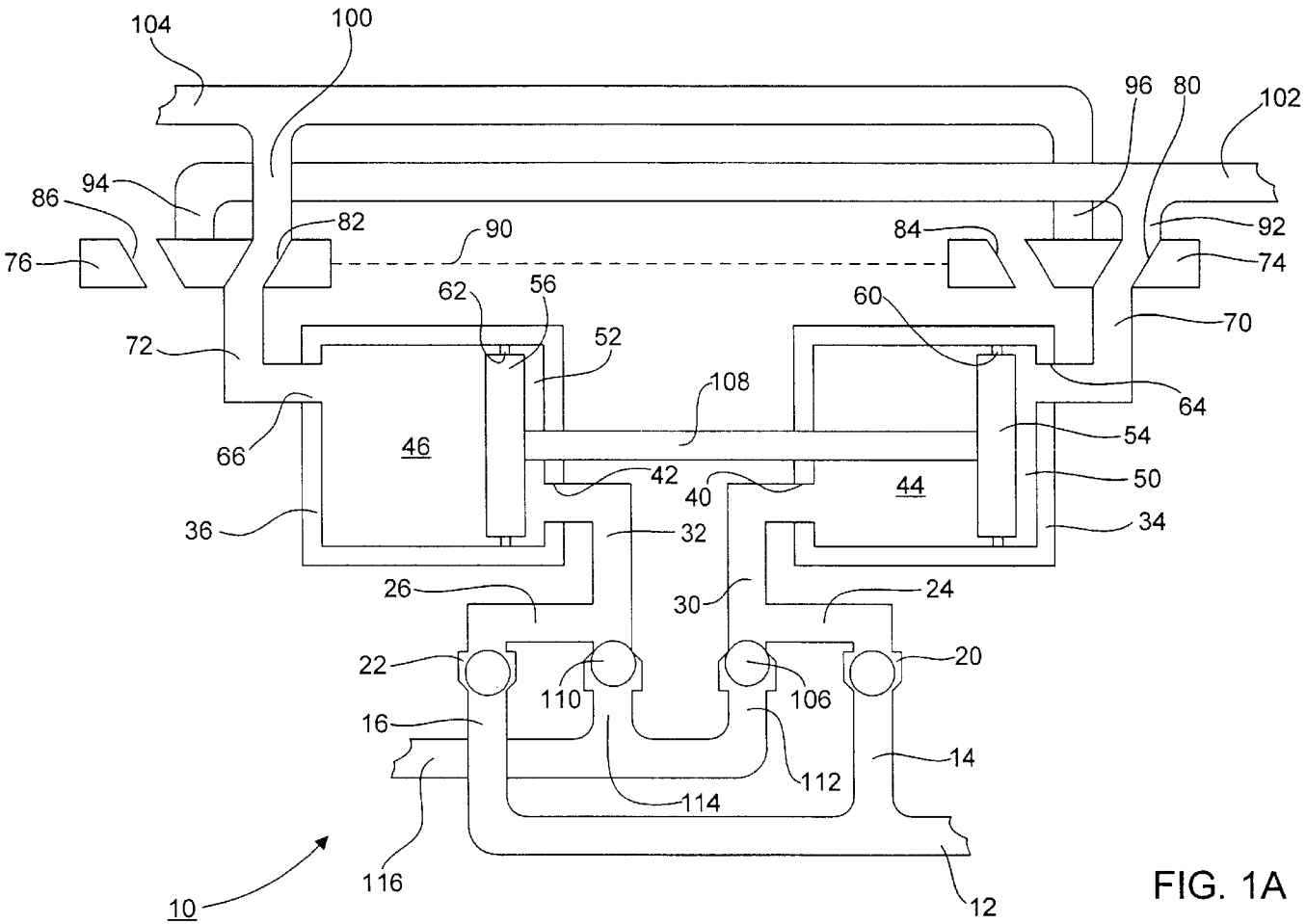
FIG. 1A depicts a schematic of a fluid motivated pump including two double acting units during a first step in a cycle according to an embodiment of the present invention.
Figure 1B:
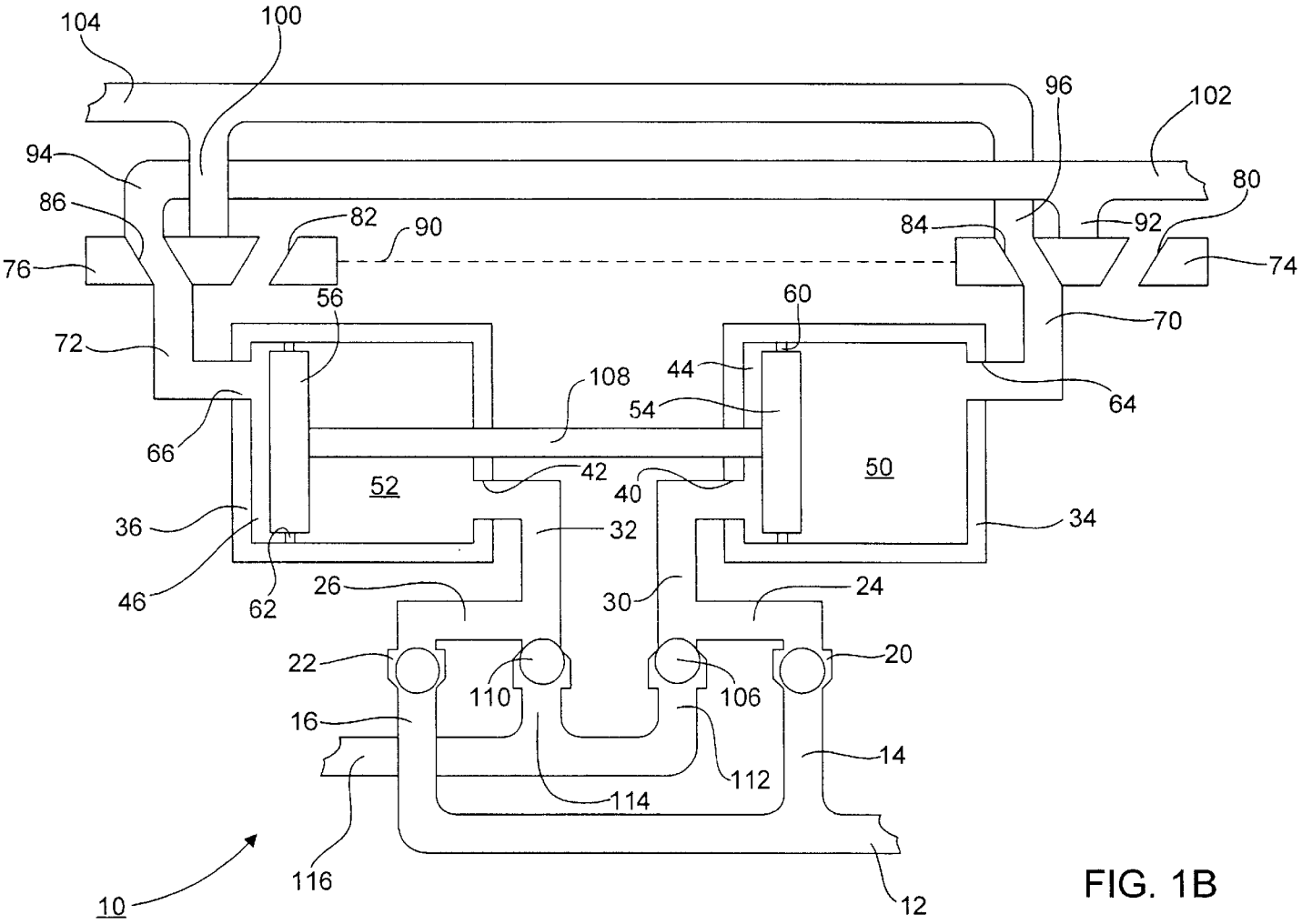
FIG. 1B depicts a schematic of a fluid motivated pump including two double acting units during a second step in a cycle according to an embodiment of the present invention.

An embodiment of the present invention includes two double acting units working together. Each unit communicates with a motivating-fluid source and a stock of fluid to be pumped through a group of valves that are opened and closed during a cycle to pump the stock fluid. FIG. 1A depicts a pump 10 during a first step of the cycle. FIG. 1B depicts the pump 10 during a second step of the cycle. Like items in FIGS. 1A and 1B have like numbers.

Before discussing the steps of the cycle depicted in FIGS. 1A and 1B, the parts of pump 10 are presented. Pump 10 includes a first unit 36 and a second unit 34. Each unit 36, 34 includes a stock-fluid port 42, 40; a piston 56, 54 splitting a cavity within each unit 36, 34 into a stock-fluid cell 52, 44 and a motivating-fluid cell 46, 50; and a motivating-fluid port 66, 64. A link 108 interconnects the pistons and coordinates the motion of the pistons 56, 54 within the cavity of each unit 36, 34. Each piston 56, 54 may include a ring seal 62, 60 at a perimeter of each piston contacting the cavity wall of its respective unit 36, 34 to prevent the contamination of the motivating fluid by the stock fluid and vice versa.

A line 12 supplies the stock fluid to the stock-fluid cell 52, 44 of each unit 36, 34 through branches 16, 14; check valves 22, 20; bridges 26, 24; stock-fluid lines 32, 30; and stock-fluid port 42, 40. A line 116 disposes of the stock fluid from the stock-fluid cell 52, 44 of each unit 36, 34 through stock-fluid port 42, 40; stock-fluid lines 32, 30; check valves 110, 106; and branches 114, 112. If desired the check valves could be replaced with suitably controlled actuated valves.

In a like manner, a line 102 supplies the motivating fluid to the motivating-fluid cells 46, 50 of each unit 36, 34 through motivating-fluid ports 66, 64; branches 94, 92; paths 86, 84 of valves 76, 74; and motivating-fluid lines 72,70. A line 104 disposes of the motivating fluid from the motivating-fluid cells 46, 50 of each unit 36, 34 through motivating-fluid ports 66, 64; motivating-fluid lines 72, 70; paths 82, 80 of valves 76, 74 and branches 100, 96. A tie 90 coordinates the motion of the valves 76, 74 to direct the motivating fluid from branches 94, 92 through paths 86, 84 to motivating-fluid lines 72, 70 and from motivating-fluid lines 72, 70; through paths 82, 80 to and from branches 100, 96 respectively.

Movement of piston 56 from right to left draws stock fluid into stock-fluid cell 52 of the first unit 36 from line 12 along branch 16 through valve 22, bridge 26, stock-fluid line 32 and stock-fluid port 42, while valve 110 remains closed. Movement of piston 56 from left to right pumps stock fluid from stock-fluid cell 52 of the first unit 36 through stock-fluid port 42, stock-fluid line 32, valve 110 and along branch 114 to line 116 for disposal while valve 22 remains closed. Motivating fluid travels to motivating-fluid cell 46 of the first unit 36 from line 102 along branch 94 through path 86 of valve 76, motivating-fluid line 72 and motivating-fluid port 66 while path 82 of valve 76 remains unavailable. Motivating fluid travels from motivating-fluid cell 46 of the first unit 36 through motivating-fluid port 66, motivating -fluid line 72, path 82 of valve 76 and along branch 100 to line 104 for disposal while path 86 of valve 76 remains unavailable.

In a like manner, movement of piston 54 from left to right draws stock fluid into stock-fluid cell 44 of the second unit 34 from line 12 along branch 14 through valve 20, bridge 24, stock-fluid line 30 and stock-fluid port 40 while valve 106 remains closed. Movement of piston 54 from right to left pumps stock fluid from stock-fluid cell 44 of the first unit 34 through stock-fluid port 40, stock-fluid line 30, valve 106 and along branch 112 to line 116 for disposal while valve 20 remains closed. Motivating fluid travels to motivating-fluid cell 50 of second unit 34 from line 102 along branch 92 through path 80 of valve 74, motivating-fluid line 70 and motivating-fluid port 64 while path 84 of valve 74 remains unavailable. Motivating fluid travels from motivating-fluid cell 50 of the second unit 34 through motivating-fluid port 64, motivating-fluid line 70, path 84 of valve 74 and along branch 96 to line 104 for disposal while path 80 of valve 76 remains unavailable.

The coordinated opening and closing of valves 22, 110, 106, and 20 in the stock-fluid circuit and the availability of paths 86 and 82 of valve 76 and paths 84 and 80 of valve 74 produces the action of piston 56 in the first unit 36 and piston 54 in the second unit 34 to pump the stock fluid. The state of the valves and paths of the first unit 36 and second unit 34 in the steps of the cycle depicted in FIGS. 1A and 1B are summarized in Table 1 below.

TABLE

State Summary for Cycle Steps of FIGS. 1A and 1B

| | FIGS. 1A Step 1 | FIGS. 1B Step 2 |
|---|---|---|
| **First Unit 36** | | |
| Action of First Unit 36 | Suction | Pump |
| Valve 22 | Opened | Closed |
| Valve 110 | Closed | Opened |
| Path 86 of Valve 76 | Unavailable | Available |
| Path 82 of Valve 76 | Available | Unavailable |
| Motivating-fluid Cell 46 | Contracting | Expanding |
| Stock-fluid Cell 52 | Expanding | Contracting |
| Piston 56 | Right to Left | Left to Right |
| **Second Unit 34** | | |
| Action of Second Unit 34 | Pump | Suction |
| Valve 20 | Closed | Opened |
| Valve 106 | Opened | Closed |
| Path 84 of Valve 74 | Unavailable | Available |
| Path 80 of Valve 74 | Available | Unavailable |
| Motivating-fluid Cell 50 | Expanding | Contracting |
| Stock-fluid Cell 44 | Contracting | Expanding |
| Piston 56 | Right to Left | Left to Right |

Step 1 of the cycle includes the pumping of stock fluid from the second unit 34 for discharge and the suctioning of stock fluid into the first unit 36 from a stock-fluid source through line 12. Referring to the first unit 36 in FIG. 1A, the circuit from motivating-fluid cell 46 to discharge motivating fluid line 104 is open. Also, the circuit from line 12 to draw stock fluid into stock-fluid cell 52 is open. Also referring to the second unit 34 in FIG. 1A, the circuit from line 102 to expand motivating-fluid cell 50 with motivating fluid is open, and the circuit from stock-fluid cell 44 to pump stock fluid through line 116 for discharge is open. Motivating fluid expands motivating-fluid cell 50 by acting on piston 54. Piston 54 moves from right to left to pump stock fluid from stock-fluid cell 44 while contracting cells 44. At the same time, piston 54 drives link 108 to move piston 56 of the first unit 36. As piston 56 moves, the expansion of stock-fluid cell 52 creates suction in the open circuit to line 12 to draw stock fluid into stock-fluid cell 52. Motivating-fluid cell 46 contracts as piston 56 moves from right to left. Step 1 ends when motivating-fluid cell 50 of the second unit 34 and stock-fluid cell 52 of first unit 36 expand to their greatest volumes and stock-fluid cell 44 of second unit 34 and motivating-fluid cell 46 of first unit 36 contract to their smallest volumes. Then, valves 74 and 76 are actuated, causing path 82 to make way for path 86 in valve 76 and path 80 to make way for path 84 in valve 74. The resulting pressure change on the sides of pistons 54 and 56 is transmitted to the stock fluid. This causes valves 22 and 106 to close and valves 20 and 110 to open. Valve 72 and 74 may be conjointly actuated by way of a tie 90, as shown in FIG. 1A. Once the path and valve states are changed, step 2 of the cycle begins. The apparatus has taken the configuration shown in FIG. 1B.

Step 2 of the cycle includes the pumping of stock fluid from the first unit 36 for discharge and the suctioning of stock fluid into the second unit 34 from a stock-fluid source through line 12. Referring to the first unit 36 in FIG. 1B, the circuit from line 102 to expand motivating-fluid cell 46 with motivating fluid is open, and the circuit to contract stock-fluid cell 52 to pump stock fluid via line 116 for discharge into is open. Also referring to the second unit 34 in FIG. 1B, the circuit from motivating-fluid cell 50 to discharge motivating fluid via line 104 is open, and the circuit from line 12 to stock-fluid cell 44 to draw stock fluid into stock-fluid cell is open. Motivating fluid expands motivating-fluid cell 46 by acting on piston 56. Piston 56 moves from left to right to pump stock fluid from stock-fluid cell 52 while contracting cell 52. At the same time, piston 56 acts through link 108 to move piston 54 of the second unit 34. As piston 54 moves, the expansion of stock-fluid cell 44 creates suction in the open circuit to line 12 to draw stock fluid into stock-fluid cell 44. Motivating-fluid cell 50 contracts as piston 54 move from left to right. Step 2 ends as motivating-fluid cell 46 of first unit 36 and stock-fluid cell 44 of second unit 34 expand to their greatest volumes and stock-fluid cell 52 of first unit 34 and motivating-fluid cell 50 of second unit 34 contract to their smallest volumes. Then, valves 74 and 76 are moved back to the positions shown in FIG. 1A. This causes path 86 to make way for path 82 in valve 76; and path 84 to make way for path 80 in valve 74. The resulting pressure change causes valves 20 and 110 close and valves 22 and 106 open. Once the path and valve states are changed, step 1 of the cycle begins again.

Figure 1C:
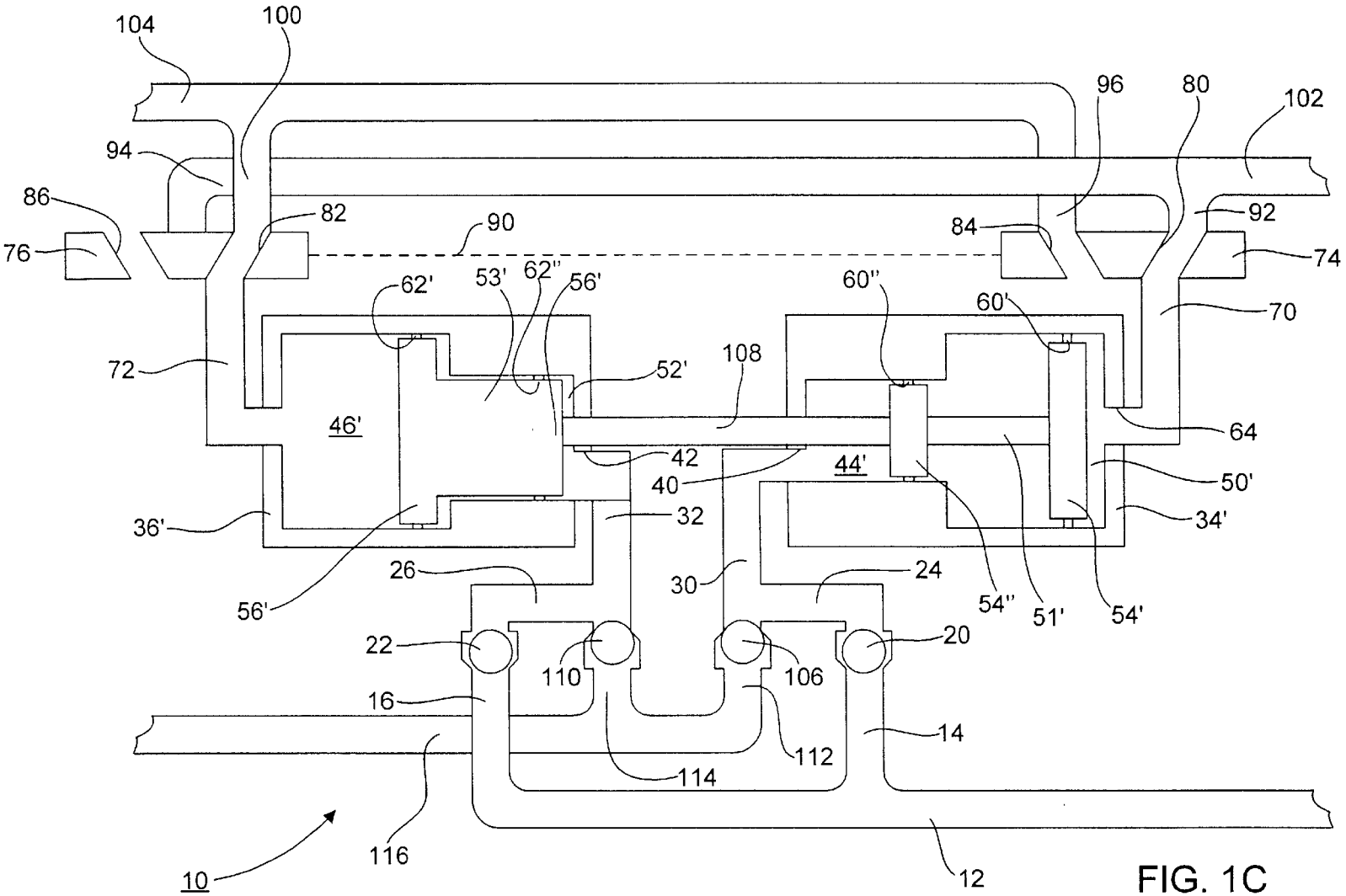
FIG. 1C depicts a schematic of an alternative fluid motivated pump including two double acting units according to an embodiment of the present invention.

Another embodiment of the present invention shown in FIG. 1C includes two double acting units working together similar to those of FIGS. 1A and 1B except that the piston and cell sizes of the motivating fluid differs from those of the stock fluid. Like items in FIGS. 1A, 1B and 1C have like numbers. A prime symbol "'"0 is used to designate a variation of an item. FIG. 1C depicts a pump 10'that includes a first unit 36'and a second unit 34'. Each unit 36, 34 includes a stock-fluid port 42, 40; a piston 56', 54', stock-fluid cell 52', 44' and a motivating-fluid cell 46', 50'; and a motivating-fluid port 66, 64. The motivating-fluid cell 46', 50' is larger than the stock-fluid cell 52', 44'. Piston 56', 54' have been modified to adapt to the cell differences. Link 51' connects piston 54' within the motivating-fluid cell to a piston 54"within the stock-fluid cell. An extension 53' of piston 56' within stock-fluid cell connects piston 56' to a piston 56". A link 108 coordinates the motion of the pistons 56', 56", 54' and 54" within the respective cells of each unit 36', 34'. Each piston 56', 56", 54' and 54" may include a seal 62", 62', 60', and 60" at a perimeter of each piston contacting the cell wall of its respective cell within unit 36', 34' to prevent the contamination of the motivating fluid by the stock fluid and vice versa. An advantage of pump 10' includes the ability to pump the stock-fluid to a higher pressure proportional to the ratio of the areas of the pistons in the motivating-fluid cell and the stock-fluid cell. Another advantage of pump 10' that is shared with pump 10 and pump having a similar design includes the pump's ability to suction and pump stock fluid at a reasonable operating pressure while not being negatively effected by the operating pressure of the motivating fluid.

Figure 2A:
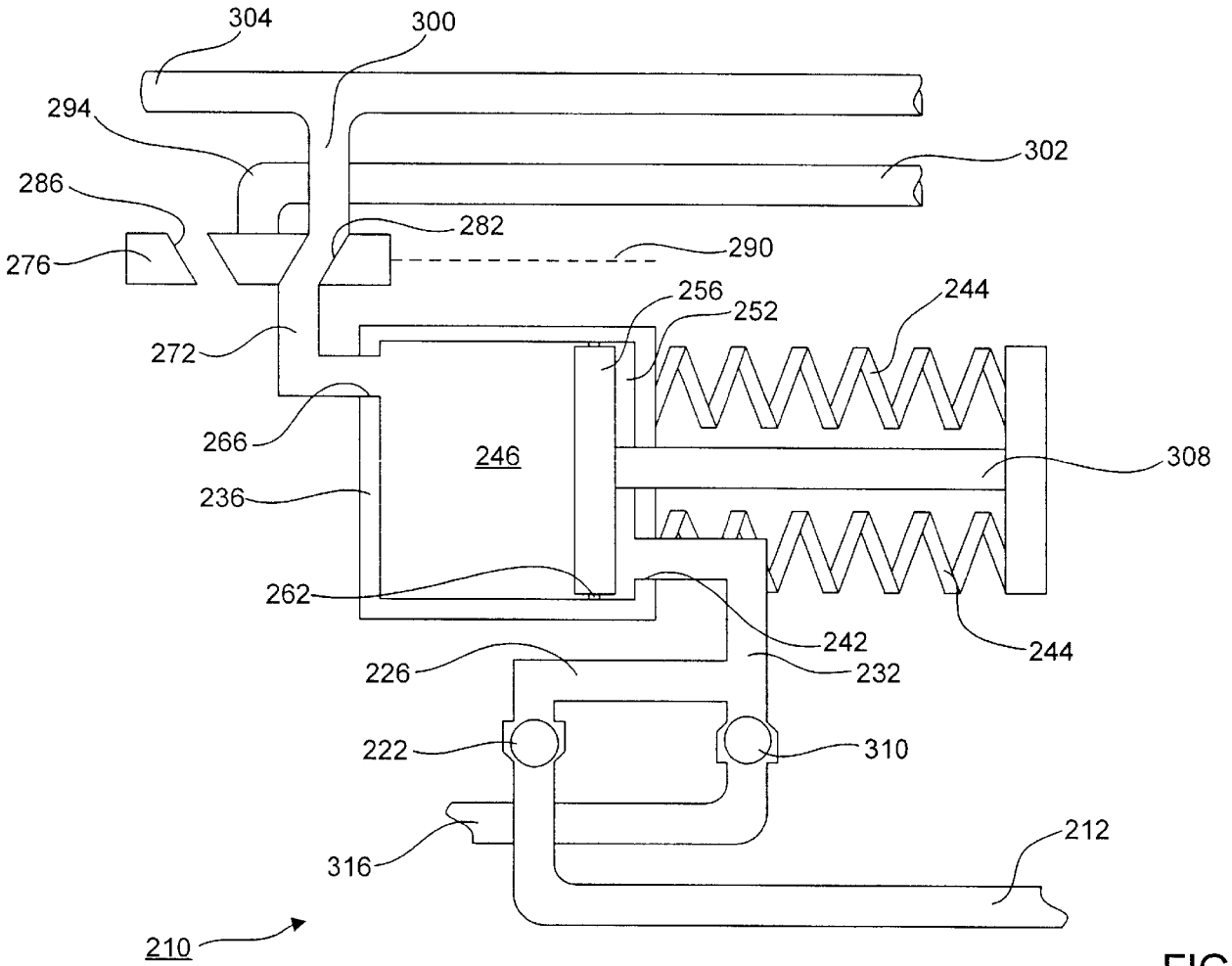
FIG. 2A depicts a schematic of a fluid motivated pump including one double acting units during a first step in a cycle according to an embodiment of the present invention.
Figure 2B:
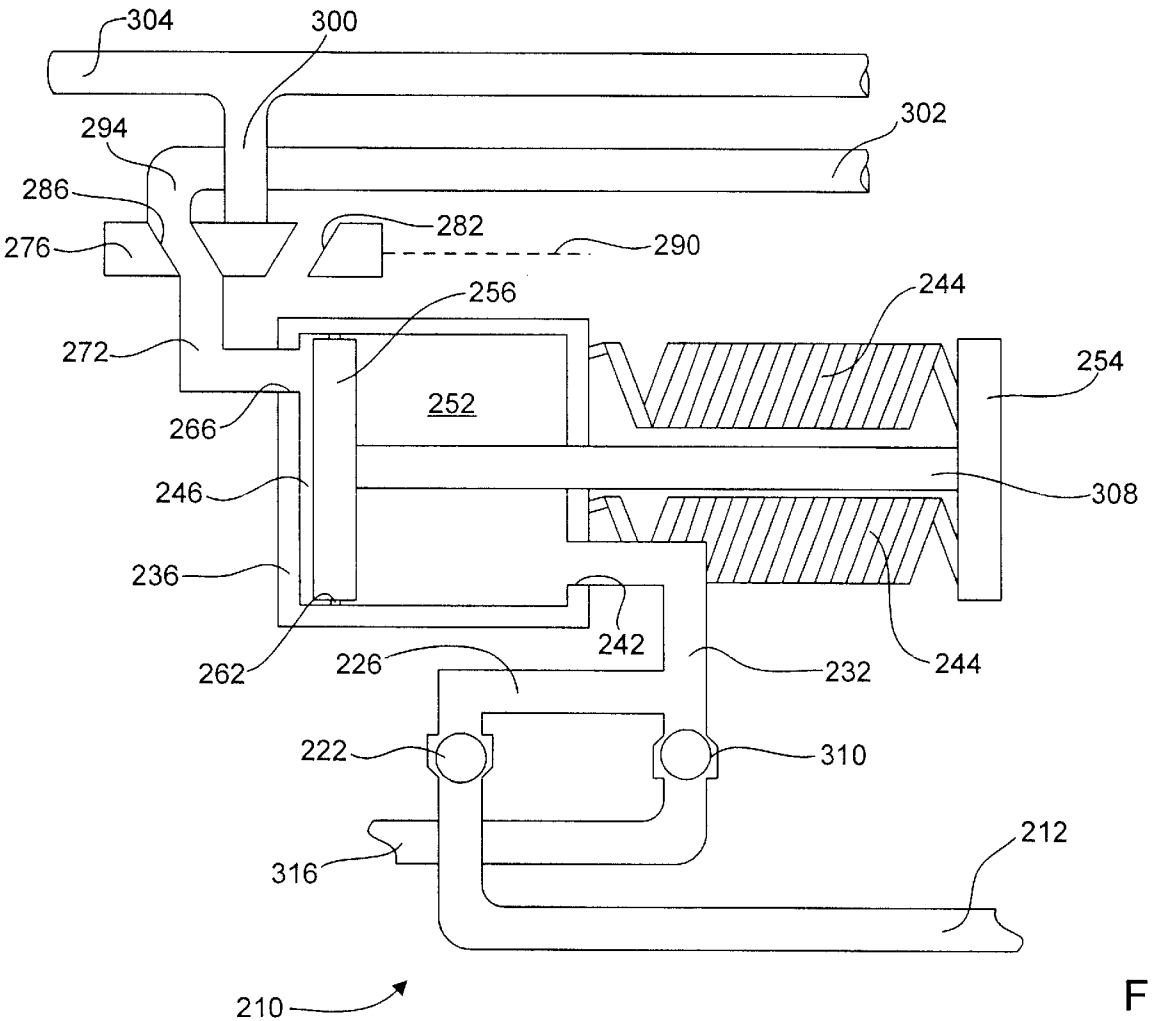
FIG. 2B depicts a schematic of a fluid motivated pump including one double acting unit during a second step in a cycle according to an embodiment of the present.

Another embodiment of the present invention includes one double acting unit working with a biasing element. FIG. 2A depicts a pump 210 during a first step of the cycle. FIG. 2B depicts the pump 210 during a second step of the cycle. Like items in FIGS. 2A and 2B have like numbers.

Before discussing the steps of the cycle depicted in FIGS. 2A and 2B, the parts of pump 210 are presented. Pump 210 includes a unit 236. The unit 236 includes a stock-fluid port 242; a piston 256 splitting a cavity within the unit 236 into a stock-fluid cell 252 and a motivating-fluid cell 246; and a motivating-fluid inlet/out 266. A link 308 coordinates the motion of the piston 256 and the biasing element 244. The piston 256 may include a seal 262 at its perimeter contacting the cavity wall of unit 236 to prevent the contamination of the motivating fluid by the stock fluid and vice versa.

A line 212 supplies the stock fluid to the stock-fluid cell 252 of the unit 236 through valve 222; bridge 226; stock-fluid line 232; and stock-fluid port 242. Line 316 disposes of the stock fluid from the stock-fluid cell 252 of the unit 236 through stock-fluid port 242; and stock-fluid line 232; valve 310.

In a like manner, a line 302 supplies the motivating fluid to the motivating-fluid cell 246 of the unit 236 through motivating-fluid inlet/out 266; branch 294; path 286 of valve 276; and motivating-fluid line 272. A line 304 disposes of the motivating fluid from the motivating-fluid cell 246 of the unit 236 through motivating-fluid inlet/out 266; motivating-fluid line 272; path 282 of valve 276 and branch 300. A tie 290, which may be an electrical connection or a mechanical connection, coordinates the availability of path 286 versus path 282 and vice versa.

Movement of piston 256 from right to left draws stock fluid into stock-fluid cell 252 of unit 236 from line 212 through valve 222, bridge 226, stock-fluid line 232 and stock-fluid port 242, while valve 310 remains closed. Movement of piston 256 from left to right pumps stock fluid from stock-fluid cell 252 of unit 236 through stock-fluid port 242, stock-fluid line 232 and valve 310 to line 316 for disposal while valve 222 remains closed. Motivating fluid travels to motivating-fluid cell 246 of the unit 236 from line 302 along branch 294 through path 286 of valve 276, motivating-fluid line 272 and motivating-fluid port 266 while path 282 of valve 276 remains unavailable. Motivating fluid travels from motivating-fluid cell 246 of the unit 236 through motivating-fluid port 266, motivating -fluid line 272, path 282 of valve 276 and along branch 300 to line 304 for disposal while path 286 of valve 276 remains unavailable.

The coordinated opening and closing of valves 222 and 310 in the stock-fluid circuit and the availability of paths 286 and 282 of valve 276 produces the action of piston 256 in unit 236 and biasing element 244 to pump the stock fluid. The state of the valves and paths of unit 236 in the steps of the cycle depicted in FIGS. 2A and 2B are summarized in Table 2 below.

Step 1 of the cycle includes the suctioning of stock fluid into unit 236 from a stock-fluid source through line 212. Referring to the unit 236 in FIG. 2A, the circuits from motivating-fluid cell 246 to discharge motivating fluid line 304 is open. Also, the circuit from line 212 to draw stock fluid into stock-fluid cell 252 are open. As biasing element 244 contracts, it acts through link 308 to move piston 256 of unit 236. As piston 56 moves, the expansion of stock-fluid cell 252 creates suction in the open circuit to line 212 to draw stock fluid into stock-fluid cell 252. Motivating-fluid cell 246 contracts as piston 256 moves from right to left. Step 1 ends when stock-fluid cell 252 expands to its greatest volumes; motivating-fluid cell 246 contracts to its smallest volume and biasing element 244 contracts to its shortest length. Then, path 282 makes way for path 286 in valve 276; valve 222 closes; and valve 310 opens. Valve 272 may have its paths make way by a tie 290 as shown in FIG. 2A. Alternatively, valves 276 may be arranged in a manner similar to valves 222 and 310 and visa versa. Once the path and valve states are changed, step 2 of the cycle begins.

TABLE 2

State Summary for Cycle Steps of FIGS. 2A and 2B

| | FIGS. 2A Step 1 | FIGS. 1B Step 2 |
|---|---|---|
| Action of Unit 236 | Suction | Pump |
| Valve 222 | Opened | Closed |
| Valve 310 | Closed | Opened |
| Path 286 of Valve 276 | Unavailable | Available |
| Path 282 of Valve 276 | Available | Unavailable |
| Motivating-fluid Cell 246 | Contracting | Expanding |
| Stock-fluid Cell 252 | Expanding | Contracting |
| Springs 244 | Contracting | Expanding |
| Piston 256 | Right to Left | Left to Right |

Step 2 of the cycle includes the pumping of stock fluid from unit 236 for discharge. Referring to unit 236 in FIG. 2B, the circuits from line 302 to expand motivating-fluid cell 246 with motivating fluid is open and the circuit to contract stock-fluid cell 252 to pump stock fluid via line 316 for discharge into are open. Motivating fluid expands motivating-fluid cell 246 by acting on piston 256. Piston 256 moves from left to right to pump stock fluid from stock-fluid cell 252 while contracting cell 252. At the same time, piston 256 acts through link 308 to expand biasing element 244. Step 2 ends as motivating-fluid cell 246 expands to its greatest volume; stock-fluid cell 252 contracts to its smallest volume; and biasing element 244 expands to its greatest length. Then, valve 276 is moved back to the positions shown in FIG. 2A. This causes path 286 to make way for path 282 in valve 276 and valve 310 closes and valve 222 opens. Once the path and valve states are changed, step 1 of the cycle begins again.

Figure 2C:
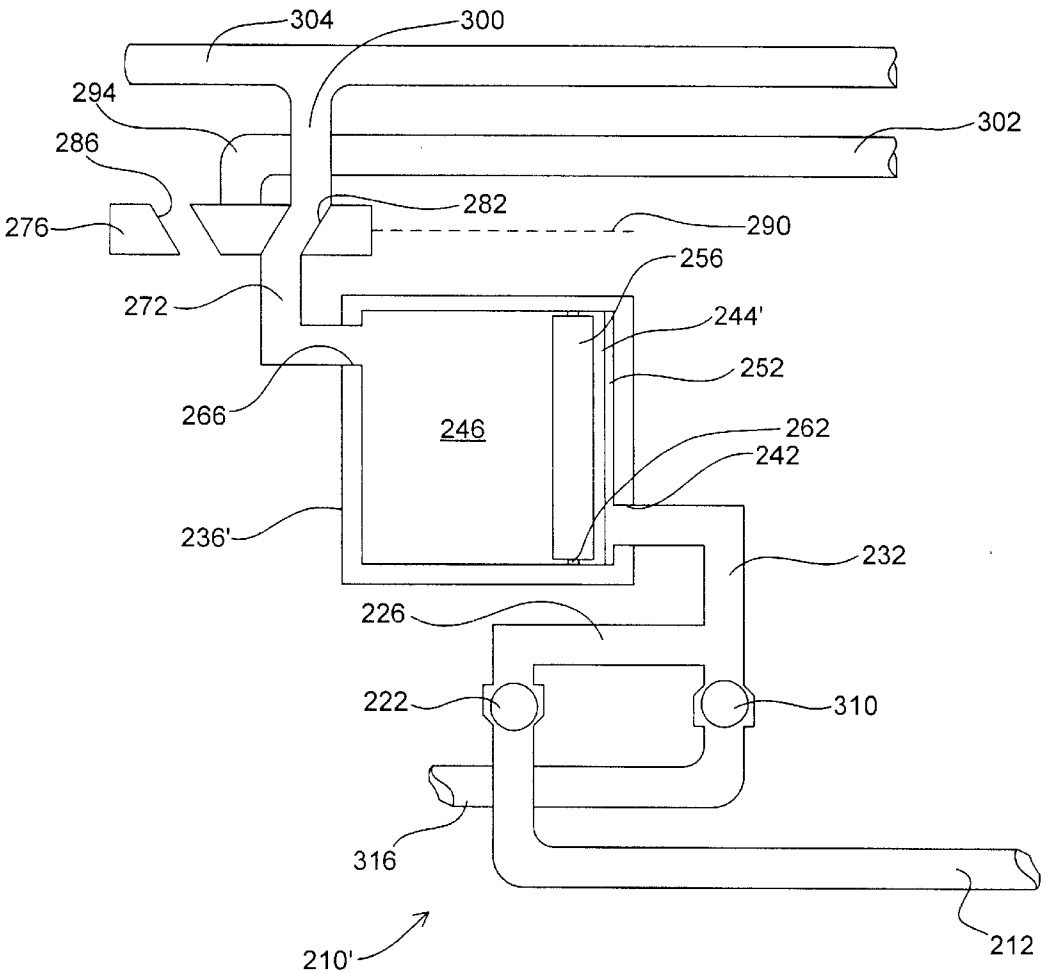
FIG. 2C depicts a schematic of an alternative fluid motivated pump including one double acting unit according to an embodiment of the present invention.
Figure 2D:
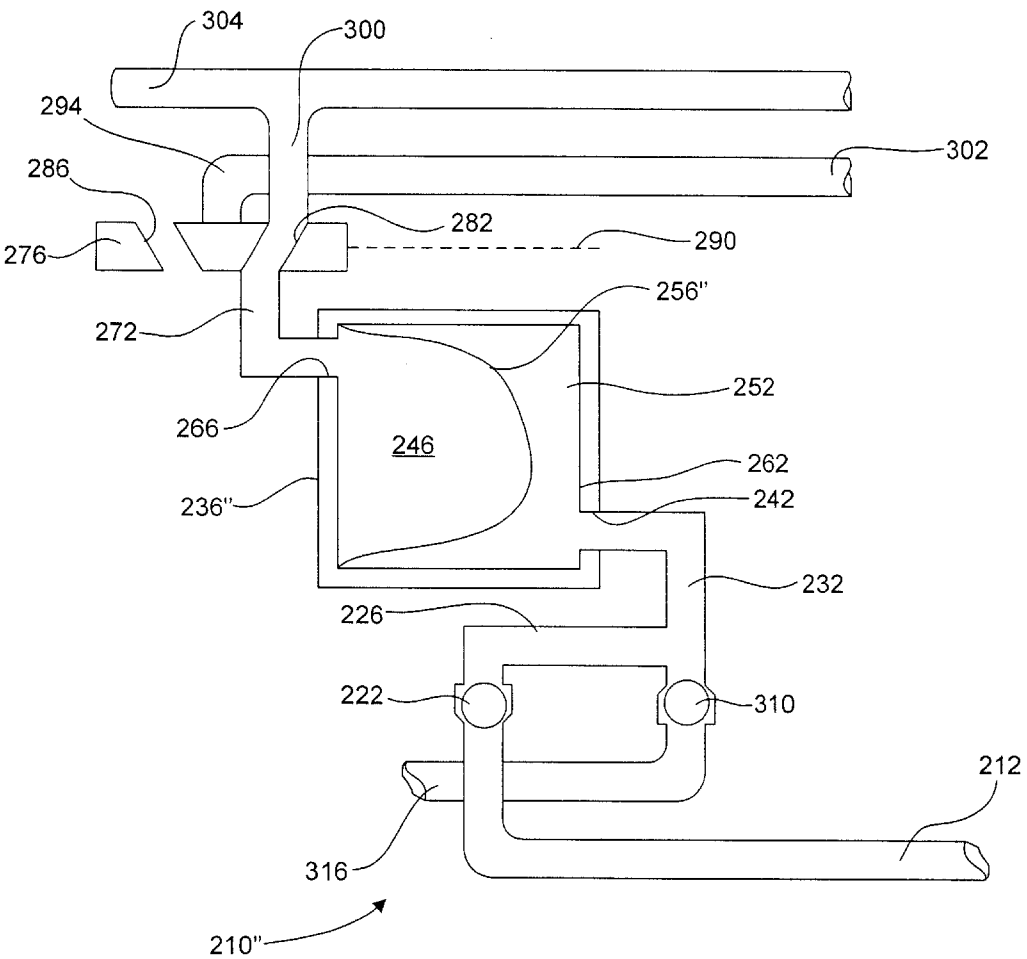
FIG. 2D depicts a schematic of an alternative fluid motivated pump including one double acting unit according to an embodiment of the present invention.

Alternative embodiments to those of FIGS. 2A and 2B include, for example, placing the biasing element within the cavity of the unit as shown in FIG. 2C and replacing the piston and biasing element with a polymeric membrane or bladder as shown in FIG. 2D. Like items in FIGS. 2A, 2B, 2C and 2D have like numbers. A prime symbol "'" is used to designate a variation of an item in FIG. 2C while a double a prime symbol "''" is used to designate a variation of an item in FIG. 2D.

FIG. 2C depicts a pump 210' that includes a unit 236'. The unit 236' includes a stock-fluid port 242; a piston 256 splitting a cavity within the unit 236' into a stock-fluid cell 252 and a motivating-fluid cell 246; and a motivating-fluid inlet/out 266. A biasing element 244' within the stock-fluid cell 252 of the cavity of the unit 236' acts directly on piston 256. The biasing element 244' is depicted in FIG. 2C as compressed to balance the pressure of the motivating fluid. The piston 256 may include a seal 262 at its perimeter contacting the cavity wall of unit 236' to prevent the contamination of the motivating fluid by the stock fluid and vice versa. An advantage of pump 210' includes the decrease in space needed to accommodate the pump when the biasing element is within the stock-fluid cell. It will be appreciated by those skilled in the art that the biasing element may be included within motivating-fluid cell or within both the stock-fluid cell and the motivating-fluid cell rather than solely within the stock as shown in FIG. 2C. If in the motivating fluid cell, the biasing element should act to compress the motivating fluid cell, such as by an extension spring.

FIG. 2D depicts a pump 210" that includes a unit 236". The unit 236" includes a stock-fluid port 242; a movably biasing boundary 256" splitting a cavity within the unit 236" into a stock-fluid cell 252 and a motivating-fluid cell 246; and a motivating-fluid port 266. Examples of the movably biasing boundary 256" include a membrane or bladder that may be polymeric or other suitable material. The biasing boundary stretches as motivating-fluid cell expands and relaxes as motivating-fluid contracts to draw stock fluid into expanding stock-fluid cell. The movably biasing boundary 256" is depicted in FIG. 2C as stretched to balance the pressure of the motivating fluid.

Figure 3A:
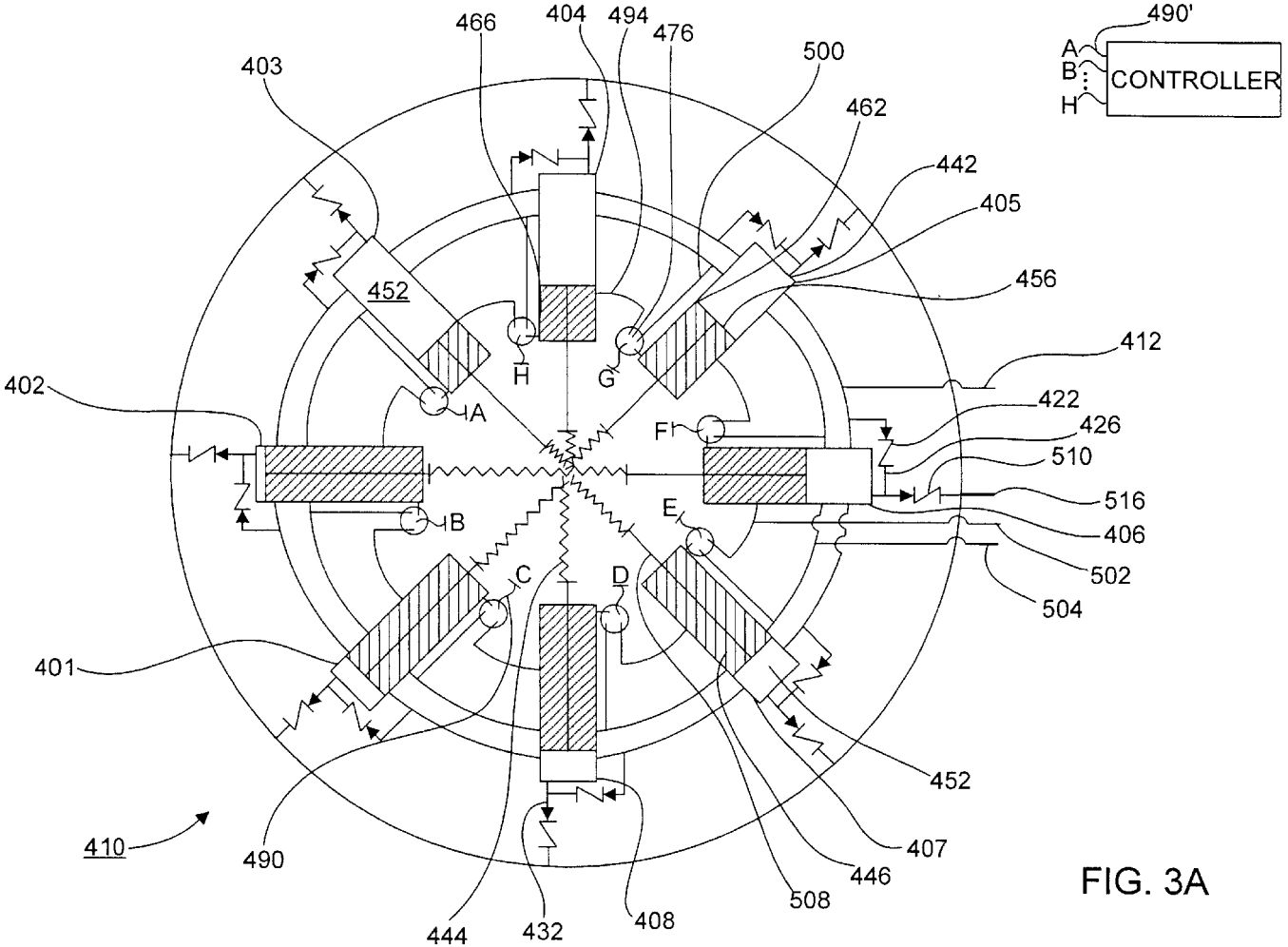
FIG. 3A depicts a schematic of a fluid motivated pump including a plurality of double acting units arranged in a circle according to an embodiment of the present invention.
Figure 3B:
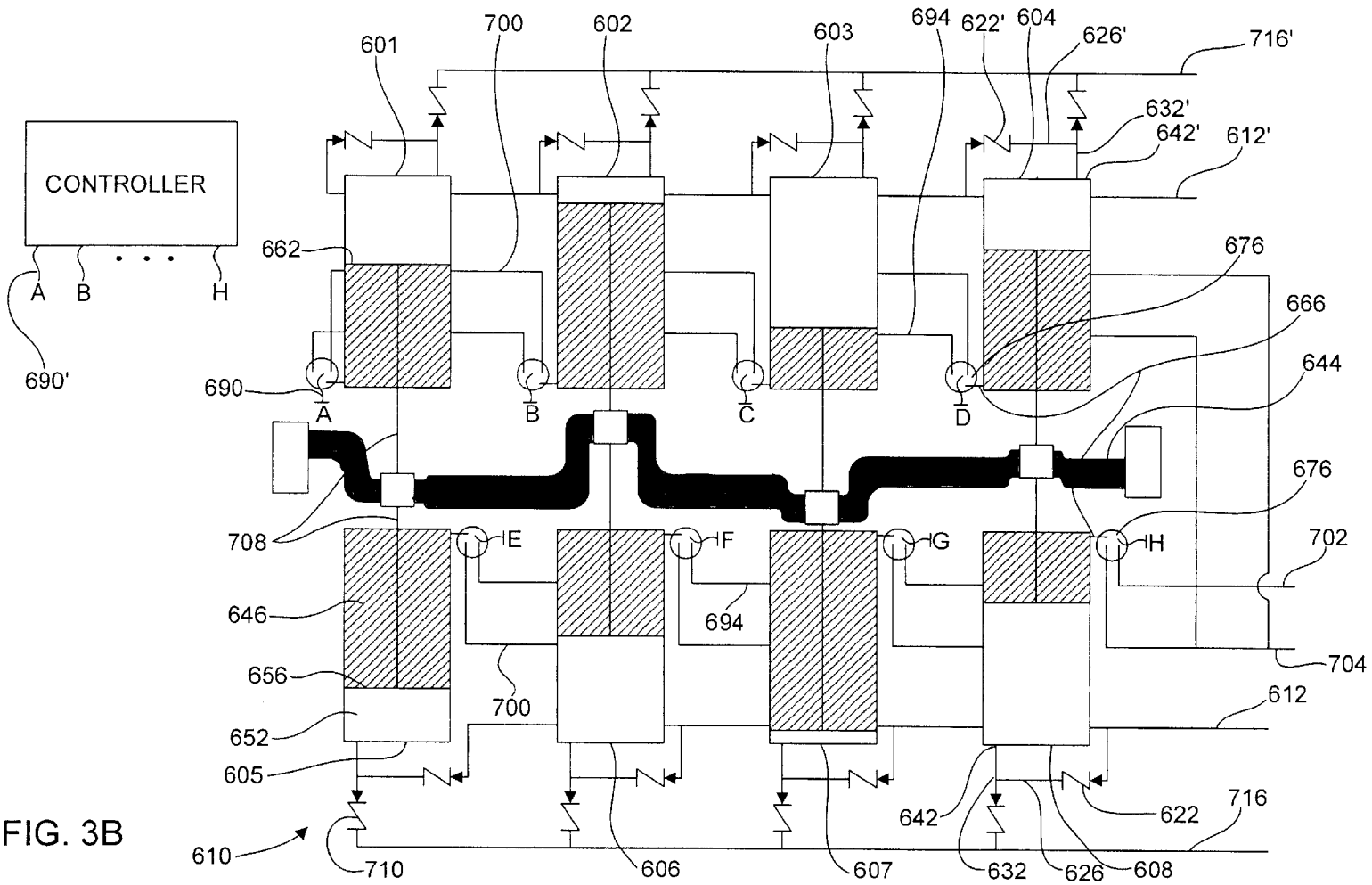
FIG. 3B depicts a schematic of a fluid motivated pump including a plurality of double acting units arrange in two lines according to an embodiment of the present.

Yet another embodiment of the present invention includes a plurality of double acting units working together. FIG. 3A depicts a pump 410 including eight units 401, 402, 403, 404, 405, 405, 407 and 408 arranged in a circle. FIG. 3B depicts a pump 610 including eight units 601, 602, 603, 604, 605, 605, 607 and 608 arranged in two lines. To minimize clutter, only selected items have been numbered in each of FIG. 3A and 3B. Is will apparent to those skilled in the art that items having similar appearance perform similar functions.

The parts of pump 410 depicted include eight units 401, 402, 403, 404, 405, 405, 407 and 408 arranged in a circle. Each unit 401, 402, 403, 404, 405, 405, 407 and 408 includes a stock-fluid port 442; a piston 456 splitting a cavity within each unit into a stock-fluid cell 452 and a motivating-fluid cell 446; and a motivating-fluid inlet/out 466. A link 508 coordinates the motion of each piston 456 and a corresponding biasing element 444. Applicants contemplate that linkages combined with an eccentric wheel may be used in place of the biasing elements. Each piston 456 may include a seal 462 at its perimeter contacting the cavity walls of its respective unit to prevent the contamination of the motivating fluid by the stock fluid and vice versa.

A line 412 supplies the stock fluid to the stock-fluid cell 452 of each unit through a valve 422; bridge 426; stock-fluid line 432; and stock-fluid port 442. Line 516 disposes of the stock fluid from the stock-fluid cell 452 of each unit 436 through stock-fluid port 442; and stock-fluid line 432; and valve 510.

In a like manner, a line 502 supplies the motivating fluid to the motivating-fluid cell 446 of each unit through motivating-fluid port 466; branch 494; and valve 476. A line 504 disposes of the motivating fluid from the motivating-fluid cell 446 of each unit through motivating-fluid port 466; valve 476 and branch 500. A tie 490 coordinates the availability of paths in valve 476.

The coordinated opening and closing of valves 422 and 510 in the stock-fluid circuit and the availability of paths in valve 476 produces the action of piston 456 in each unit and it corresponding biasing element 444 to pump the stock fluid. The coordination may be accomplished with a controller as shown in FIG. 3A. The controller synchronizes the paths within the valve 476 to create the proper in-flow and out-flow of motivating fluid.

Alternatively, the units may be arranged in a line as in pump 610 of FIG. 3B. The parts of pump 610 include eight units 601, 602, 603, 604, 605, 605, 606, 607 and 608 arranged in two lines. Each unit 601, 602, 603, 604, 605, 605, 606, 607 and 608 includes a stock-fluid port 642, 642'; a piston 656 splitting a cavity within each unit into a stock-fluid cell 652 and a motivating-fluid cell 646; and a motivating-fluid port 666. A camshaft 644 through link 708 coordinate the motion of each piston 656. Each piston 656 may include a seal 662 at its perimeter contacting its respective unit to prevent the contamination of the motivating fluid by the stock fluid and vice versa.

This embodiment also demonstrates that a single motivating fluid may be used to pump a plurality of stock fluids. That is, a line 702 supplies the motivating fluid to the motivating-fluid cell 646 of each unit 601, 602, 603, 604, 605, 606, 605, 607 and 608 through motivating-fluid port 666; branch 694; valve 676; and motivating-fluid line 672. A line 704 disposes of the motivating fluid from the motivating-fluid cell 646 of each unit 601, 602, 603, 604, 605, 605, 606, 607 and 608 through motivating-fluid port 666; valve 676 and branch 700. A tie 690 coordinates the availability of paths in valve 676.

A first line 612 supplies a first stock fluid to the stock-fluid cell 652 of units 605, 606, 607 and 608 through a valve 622; bridge 626; stock-fluid line 632; and stock-fluid port 642. A first line 716 disposes of the first stock fluid from the stock-fluid cell 652 of units 605, 607 and 608 through stock-fluid port 642; and stock-fluid line 632; and valve 710. A second line 612' supplies a second stock fluid to the stock-fluid cell 652 of units 601, 602, 603 and 604 through a valve 622'; bridge 626'; stock-fluid line 632; and stock-fluid port 642. A second line 716' disposes of the second stock fluid from the stock-fluid cell 652 of units 601, 602, 603 and 604 through stock-fluid port 642; and stock-fluid line 632'; and valve 710'.

The coordinated opening and closing of valves 622, 622' and 710, 710' in the stock-fluid circuit and the availability of paths in valve 676 produces the action of piston 656 in each unit and camshaft 644 to pump the stock fluid. The coordination may be accomplished with a controller as shown in FIG. 3B. The controller synchronizes the paths within the valve 676 to create the proper in-flow and out-flow of motivating fluid.

A state summary table as was made for pump 10 of FIGS. 1A and 1B and pump 210 of FIGS. 2A and 2B may be made for pump 410 of FIG. 3A and pump 610 of FIG. 3B. The compiling of such tables is within the scope of those skilled in the art. Thus, such tables are not presented.

In regard to the parts that makeup pumps 10, 10', 210, 410 and 610 described above as well as aspects of the working of the a pump of the present invention, more discussion follows. In particular, details relating to the valves of the stock-fluid circuit; the unit or units of each pump; the valves of the motivating-fluid circuit; the motivating fluid and controllers for coordinating the opening and closing of the valve follow.

The valves of the stock-fluid circuit may be any types that achieve the goal of a pump according to the present invention. A particularly useful valve type is a check valve. Check valves may be placed in the stock-fluid circuit to direct the flow of stock fluid from the stock-fluid source to the stock-fluid cell during its filling and from the stock-fluid cell to the discharge line during pumping. A particularly useful check valve type is that known commercially as a duckbill check valve available from, for example, Linatex Inc., having its US headquarters in Gallatin, Tenn. Check valves are commercially available from industrial suppliers such as W. W. Grainger, Inc.

A unit used to suction and pump the stock fluid may be any types that achieve the goal of the pump according to the present invention. Although each unit is depicted in FIGS. 1A, 1B, 1C, 2A, 2B, 3A, and 3B as occupying a substantially rectangular prismatoid, it will be appreciated by those skilled in the art that any shape that accomplishes the pumping of the stock fluid may be used. For example, each unit might be a cylinder having an irregular cross-section or a regular cross-section, such as for example, circular, elliptical, polygonal, etc. A particularly useful unit is a cylinder type unit having a circular cross-section. These units may range from less than an inch in diameter to a foot or more in diameter. The unit may be custom manufactured or purchased as an off the shelf-item. Cylinder type units are commercially available from industrial suppliers such as W. W. Grainger, Inc.

The biasing element as used in certain embodiments may be any type that achieves the goal of a pump according to the present invention. A particularly useful biasing element is a spring. Various springs may be used including a helical spring that is stretched as shown in FIGS. 2A, 2B and 3A. Alternatively, the helical spring may be compressed while acting against the link of the piston. It will be appreciated by those skilled in the art that other types of springs and their corresponding arrangement may include simple leaf springs, laminated leaf springs, coiled springs, spiral springs, torsion springs and driving springs. Other parts that may function as the biasing element include any elastically compressible or expandable arrangement or material that may act with the link to return a piston to a position so that a motivating-fluid cell volume is minimized when the pressure of the motivating fluid is removed. Examples of biasing elements thus include reversibly compressible or expandable materials such as metals, polymers and composites, bladders including compressible and/or incompressible fluid, and magnet arrangements. One unit of the pump 10 may be regarded as a biasing element for the other. Also, a camshaft and/or the eccentric connection to a wheel may be regarded as a biasing element in embodiments that follow.

A piston with a biasing element falls within the broader concept of a movably biasing boundary disposed within the cavity of a unit. Such a movably biasing boundary divides the cavity into the motivating-fluid cell and the stock-fluid cell. Other examples of movably biasing boundary include a polymeric membrane or bladder that stretches as motivating-fluid cell expands and relaxes as motivating-fluid cell contracts to draw stock fluid into expanding stock-fluid cell.

The valves of the motivating-fluid circuit may be any types that achieve the goal of a pump according to the present invention. A particularly useful valve type is a solenoid valve. A solenoid valve may be placed in the motivating-fluid circuit to direct the flow of motivating fluid into the motivating -fluid cell to drive a piston while pumping the stock fluid. Also, a solenoid valve may be actuated in the motivating-fluid circuit to bleed the motivating fluid from the motivating fluid cell while suctioning the stock-fluid into the stock-fluid cell. Solenoid valves appropriate for use in a pump of the preset invention include those commercially available from industrial suppliers such as W. W. Grainger, Inc.

Motivating fluid may be any type that achieves the goal of a pump according to the present invention. A particularly useful motivating fluid is potable water supplied at pressure such as municipal water supply pressures. Other useful motivating fluids include liquids and compressed gasses such as compressed air.

Controllers may be any types that achieve the goal of a pump according to the present invention. A controller may run the spectrum from simple manual control though mechanical, electromechanical to complex computer programmed logic control (PLC). Particularly useful controllers include time circuits and microprocessor circuits. The pump may be selectively actuated by various other methods. For example, a pressure sensor may sense the piston position, the motivating-fluid level or volume, the stock-fluid level or volume and output a signal to actuate the valves in the motivating fluid circuit. Alternately, a timer may toggle the motivating-fluid valve actuation. In addition, the motivating fluid valve actuation may be triggered by sensing that the piston has completed its travel in one direction or another. A mechanical and/or electrical linkage to accomplish this result is within the scope of this invention.

Figure 4:
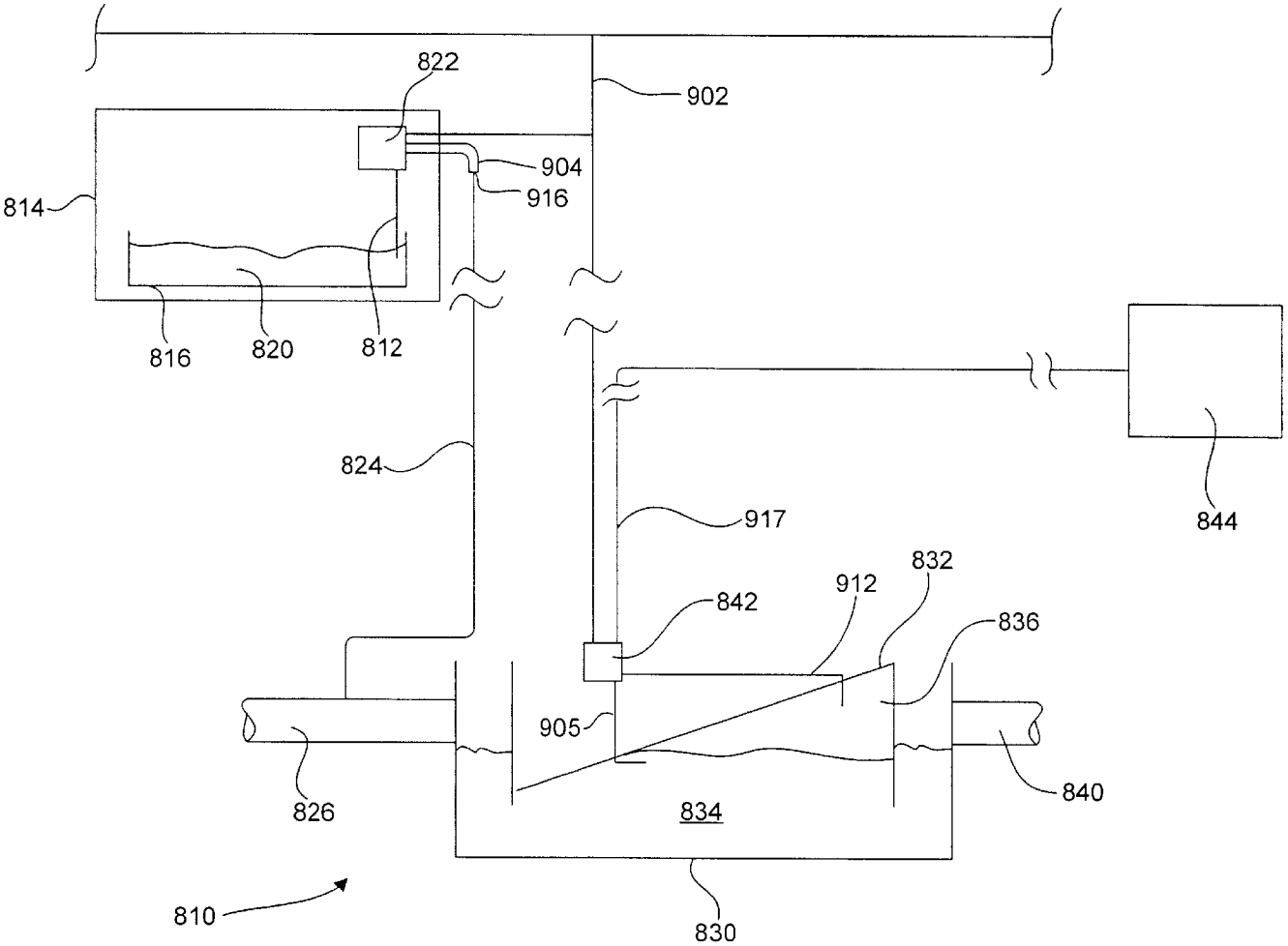
FIG. 4 depicts a schematic of a system incorporating fluid motivated pumps according to an embodiment of the present invention.

A further aspect of the present invention provides an application of the pump of any of the previous embodiments. FIG. 4 shows a system 810 including a first pump 822 and a second pump 842 according to the present invention. The first pump 822 is used to transmit a grease/water mixture 820 from an appliance to a collection line 826 of a separator unit 830. The second pump 842 is used to transmit a grease part 836 separated in the separator unit 830 to a holding tank 844. Both pumps 822, 842 are useful in commercial food preparation operations. As will become apparent, the water used as the motivating fluid is preferably hot water for pump 842.

Referring to appliance 814 that includes pump 822, it may be any of the type used in commercial food preparation operations. Such appliances may include any equipment or process that produces or results in a grease/water mixture. Examples of equipment that perform processes that might result in grease/water mixtures include a sink, a dishwasher, a cooker, pasteurizer, a blancher, an oven, a dryer, a grille etc. The appliance may include a tank 816 containing a grease/water mixture 820 that is a stock fluid to be pumped. A line 812 of the pump 822 communicates with the grease/water mixture 820. A line 902 provides the pump 822 potable water as the motivating fluid at about nominal water pressure (e.g., ranging from about 30 to about 60 pounds per square inch (psi) and more typically from about 40 to about 50 psi). Also, the pump 822 includes a grease/water discharge line 916 and a potable water discharge line 904, both shown to communicate with collection 826 through line 824. To remove grease/water mixture from tank 816 to separator 830, pump 822 is run, and both the grease/water mixture 820 and the potable water are transmitted to separator 830.

Referring to separator 830 that includes pump 842, it may be any of the type used in commercial food preparation operations. Such separators may include any equipment or process that separates a grease/water mixture into a grease part and a gray water part. A particularly popular and effective separator has been the Big Dipper® separator sold by Thermaco, Inc. of Asheboro, N.C., USA. One model of the Big Dipper® separator uses a rotating oleophilic wheel to pull grease from the top of a body of a grease/water mixture to be scraped off by a blade. Another separator is that described in U.S. patent application Ser. No. 09/439,900, filed Nov. 12, 1999, entitled "Readily Serviceable Separator Unit with a Focusing Plate." This separator 830 includes a focusing plate 832 that separates a grease/water mixture 834 into a grease part 836 and a gray water part that than passes through the separator 830 in to a sewer line 840. The grease part 836 is transmitted from the surface of the grease/water mixture 834 to a holding tank 844 for later appropriate disposal. A line 912 of the pump 842 communicates with the grease part 836. A line 902 communicates with the pump 842 to provide potable water as the motivating fluid at about nominal city water pressure (e.g., ranging from about 40 to about 50 psi). Preferably, the potable water is hot water that can be directed into the separator 830 to add heat to the mixture 834 so the grease stays liquid. Also, the pump 842 includes a grease part discharge line 917 and a potable water discharge line 905. When pump 842 is run, the grease part 836 is transmitted to the holding tank 844 and the potable water is transmitted to separator 830 just below the grease part 836.

A pump according to the present invention may be constructed from any materials that are compatible with the motivating fluid, as well as the stock fluid. In certain applications, the construction materials may also be dictated by industry and/or government standards. For example, in commercial food preparation operations, county and/or city health codes may need to be consulted and, in the case that the products are being exported, foreign government health codes may need to be consulted. Notwithstanding the above, a pump of the present invention, and its part may be constructed from metals; ceramics including concrete and moldable cements; polymers; composites base on metals, ceramics, and polymers; either partially, completely, or with combinations thereof.

The previously described versions of the present invention have many advantages, including allowing the transmission of a stock fluid without the use of an electrical motor. More particularly, the present invention is advantageous for use in commercial food preparation operations to relieve surcharges that might otherwise be charged by municipal authorities.

Although the present invention has been described in considerable detail with respect to a certain preferred versions thereof, other versions are possible. Examples include use of a pump of any of the previous embodiments with a flammable fluid to remove an explosive hazard that may otherwise be present when a pump driven by an electrical motor is used. Examples of flammable fluids include heating fuel, gasoline, kerosene, aviation fuel, hydrogen, methane, ethane, propane and the like. Therefore, the spirit and scope of the appended claims should not be limited to the description of the preferred versions herein.

All patents and other documents identified in the present application are hereby. incorporated by reference.

We claim:

1. A pump for conveying a stock fluid by supplying and expelling a motivating fluid, the pump comprising:

a plurality of units, each unit including:

a body having a cavity;

a movably biasing boundary disposed within the cavity thereby defining a motivating-fluid cell and a stock-fluid cell, each cell volume variable by the movement of the movably biasing boundary within the cavity;

a motivating-fluid opening in the body for fluid communication with the motivating-fluid cell;

a stock-fluid opening in the body for fluid communication with the stock-fluid cell;

a motivating-fluid valve in fluid communication with the motivating-fluid opening to the body;

a stock-fluid valve in fluid communication with the stock-fluid opening to the body;

a motivating-fluid line and motivating-fluid discharge line in fluid communication with the motivating-fluid valve and a stock-fluid line and a stock-fluid discharge line in fluid communication with the stock-fluid valve; and wherein the motivating-fluid line of each unit comes from the same source, the motivating-fluid discharge line of each unit directs to the same location, the stock-fluid line of each unit comes from a plurality of different sources, and the stock-fluid discharge line of each unit directs to a plurality of different locations.

2. A pump according to claim 1, wherein a motivating fluid is provided at a pressure comparable to the pressure of a municipal water supply.

3. A pump for conveying a stock fluid by supplying and expelling a motivating fluid, the pump comprising:

a plurality of units, each unit including:

a body having a cavity;

a movably biasing boundary disposed within the cavity thereby defining a motivating-fluid cell and a stock-fluid cell, each cell volume variable by the movement of the movably biasing boundary within the cavity;

a motivating-fluid opening in the body for fluid communication with the motivating-fluid cell;

a stock-fluid opening in the body for fluid communication with the stock-fluid cell;

a motivating-fluid valve in fluid communication with the motivating-fluid opening to the body;

a stock-fluid valve in fluid communication with the stock-fluid opening to the body;

a motivating-fluid line and motivating-fluid discharge line in fluid communication with the motivating-fluid valve and a stock-fluid line and a stock-fluid discharge line in fluid communication with the stock-fluid valve; and wherein the motivating fluid-line of each unit comes from the same source, the motivating-fluid discharge line of each unit directs to the same location, the stock-fluid line of each unit comes from a plurality of different sources, and the stock-fluid discharge line of each unit directs to the same locations.

4. A pump according to claim 3, wherein a motivating fluid is provided at a pressure comparable to the pressure of a municipal water supply.

5. A method of conveying a first fluid comprising:

providing a unit having a cavity including a movable biasing boundary disposed therein to define a first cell and a second cell, each having a variable volume;

directing a second fluid at a pressure into the second cell to act on the movably biasing boundary to expand the second cell until the pressure of the second fluid is substantially balanced by the movable biasing boundary or the second cell has expanded to diminish the first cell volume to a minimum;

contracting the second cell through the movement of the movable biasing boundary to discharge the second fluid from the second cell and thereby expanding the first cell drawing the first fluid from a source into the first cell;

repeating the act of directing the second fluid thereby discharging the first fluid from the first cell, thereby conveying it;

providing a second unit having a second cavity including a second movably biasing boundary disposed therein to define a third cell and a fourth cell, each having a variable volume;

coupling the movement of the movably biasing boundary and the second movably biasing boundary;

directing of the second fluid at a preselected pressure into the unit past the second opening to act on the movably biasing boundary to expand the second cell until the preselected pressure of the second fluid, substantially balanced by the movably biasing boundary, corresponds with a permitting of the second cell to contract through the movement of the second movably biasing boundary to discharge the second fluid from a second opening of the second unit and a drawing of the first fluid from a source into a first opening of the second unit in fluid communication with the second-first cell as the second-first cell expands;

permitting of the second cell to contract through the movement of the movably biasing boundary to discharge the second fluid from the second opening and thereby drawing the first fluid from a source into a first opening of the unit as the first cell expands which corresponds with a directing of the second fluid at a preselected pressure into the second unit past a second opening therein to act on the second movably biasing boundary to expand the second-second cell until the preselected pressure of the second fluid is substantially balanced by the second movably biasing boundary; and repeating of the directing of the second fluid to discharge the first fluid from the first cell by the first opening and the directing of the first fluid conveying it while a repeating of the directing of the second fluid to discharge the first fluid from the second-first cell by the first opening of the second unit and directing the first fluid thereby to convey it and wherein the second fluid conveyed by the unit is substantially different from the second fluid conveyed by the second unit.

6. A method according to claim 5, wherein the second fluid comprises water provided at a pressure comparable to the pressure of a municipal water supply.

* * * * *